US005205610A

United States Patent [19]

Reninger

[11] Patent Number: 5,205,610

[45] Date of Patent: Apr. 27, 1993

[54] FOLDING SEAT

[76] Inventor: Donald J. Reninger, 1223 W. Grand Ave., Chicago, Ill. 60622

[21] Appl. No.: 772,249

[22] Filed: Oct. 7, 1991

[51] Int. Cl.[5] ..... B60N 2/02

[52] U.S. Cl. ..... 297/380; 297/17; 297/292

[58] Field of Search ..... 297/16, 17, 380, DIG. 6, 297/300, 301, 291, 292, 381; 190/8, 106; 16/307, 308; 267/155, 154, 166, 170

[56] References Cited

U.S. PATENT DOCUMENTS

| | | | |
|---|---|---|---|
| 289,115 | 11/1883 | McDonald | 297/292 |
| 376,886 | 1/1888 | Holden | 297/292 |
| 941,672 | 11/1909 | Canfield | 16/307 X |
| 1,633,695 | 6/1927 | Colley | 267/155 X |
| 2,044,717 | 6/1936 | McElmoyl | 190/8 |
| 2,239,669 | 4/1941 | Blake | 297/380 X |
| 2,640,520 | 6/1953 | Miller et al. | 190/106 |
| 3,176,741 | 4/1965 | Brenner | 190/106 |
| 3,220,767 | 11/1965 | Hendrickson | 297/DIG. 6 X |
| 3,422,938 | 1/1969 | Worcester | 297/378 X |
| 3,825,298 | 7/1974 | Chipman | 297/380 X |
| 4,383,713 | 5/1983 | Roston | 297/DIG. 6 X |
| 4,466,659 | 8/1984 | Carpentier et al. | 297/191 |
| 4,588,224 | 5/1986 | Hill, Jr. | 297/DIG. 6 X |
| 4,824,171 | 4/1989 | Hollingsworth | 297/380 X |
| 4,843,662 | 7/1989 | Handelman | 297/DIG. 6 X |
| 4,863,003 | 9/1989 | Carter | 190/8 |
| 5,018,790 | 5/1991 | Jay | 297/DIG. 6 X |

FOREIGN PATENT DOCUMENTS

| | | | |
|---|---|---|---|
| 2856366 | 2/1980 | Fed. Rep. of Germany | 297/DIG. 6 |
| 0012022 | of 1913 | United Kingdom | 190/106 |

*Primary Examiner*—Kenneth J. Dorner
*Assistant Examiner*—Milton Nelson, Jr.
*Attorney, Agent, or Firm*—Hill, Steadman & Simpson

[57] ABSTRACT

A compact folding seat, that can also be used as a satchel for carrying picnic or beach items, includes a folding frame having two interconnected wire frame members. Torsion springs are provided for spreading the wire frame members apart from a carrying position to a seating position. The folding frame is surrounded by a fabric that forms a back portion, a seat portion, and at least one triangular-shaped seat side. The folding seat is maintained in the carrying position by securing a pair of adjustable straps to a pair of releasable securing retainers. A pair of handles can be provided for carrying the folding seat.

1 Claim, 2 Drawing Sheets

FIG. 1
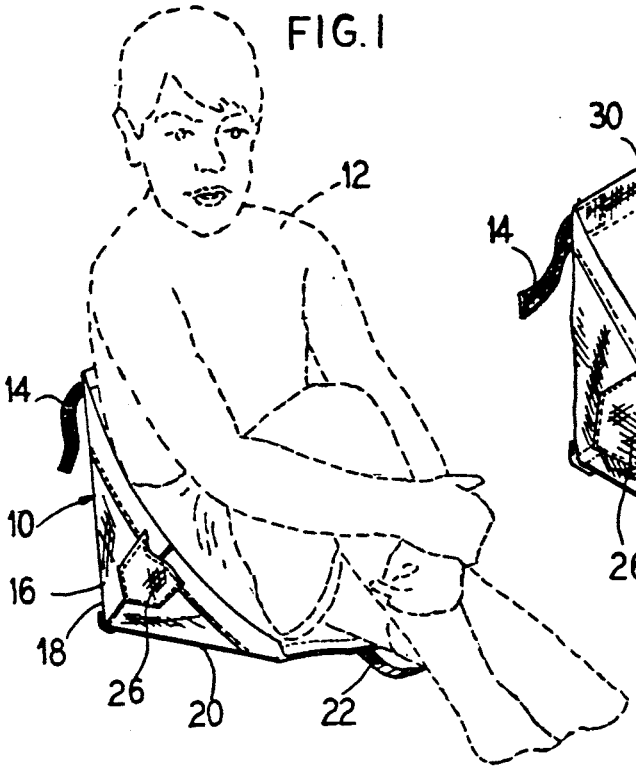
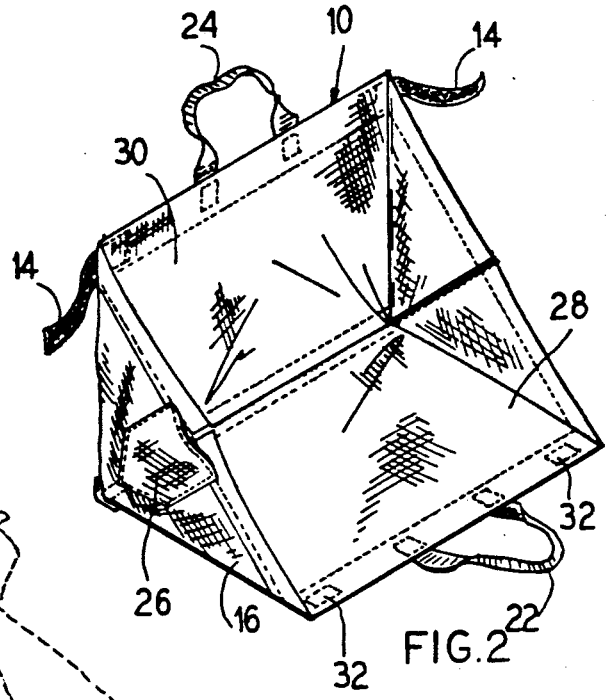
FIG. 2
FIG. 3
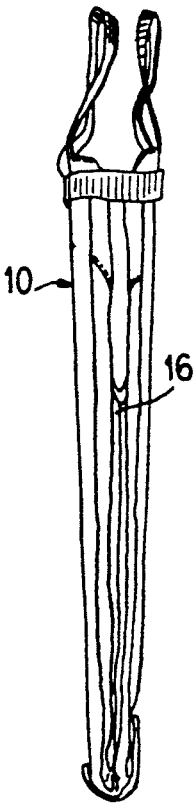
FIG. 4
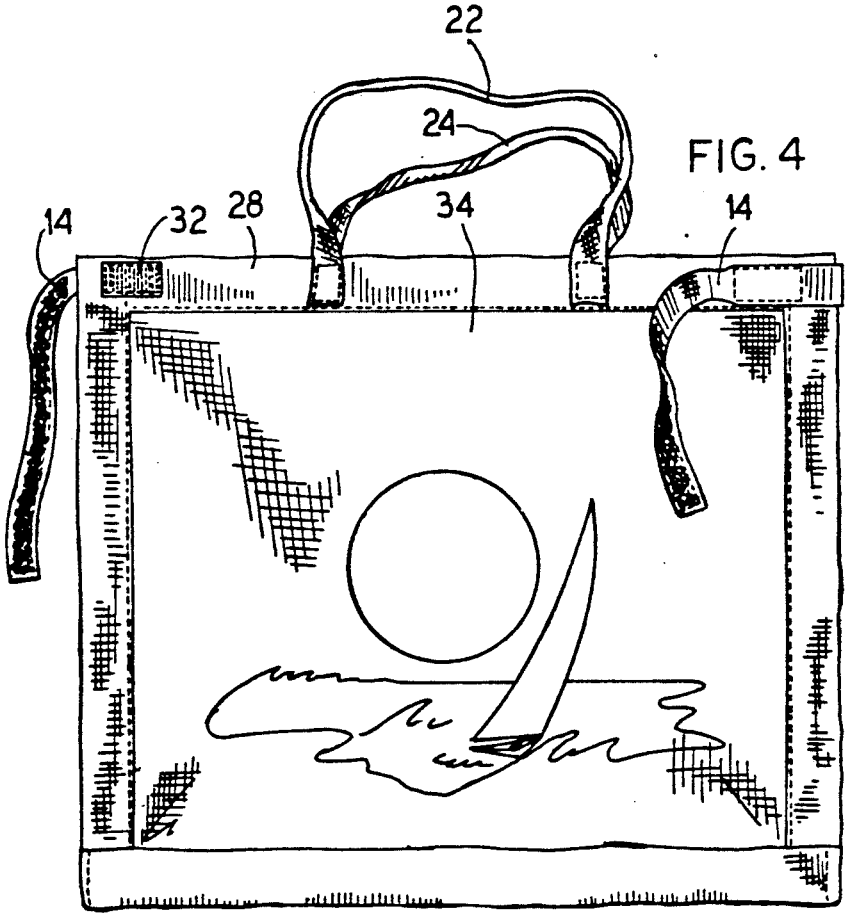

FOLDING SEAT

FIELD OF THE INVENTION

The present invention relates to a portable folding seat having a spring biased frame.

BACKGROUND OF THE INVENTION

In recent years, various portable seating devices have been developed. Such devices are particularly useful at outdoor events, such as concerts and holiday celebrations, a well as at picnics or at the beach.

Although many of these devices provide useful portable seating, they are generally unwieldy, and represent yet another object to be transported to the event site. Thus, such devices fail to address many the problems encountered by individuals needing a more compact folding seat. Further, such devices fail to make any provision for carrying, for example, food, beach towels, or other personal items.

SUMMARY OF THE INVENTION

It is, therefore, an object of the present invention to provide a folding seat that is compact, and further provides a compartment for carrying additional times within the folding seat.

The present invention accomplishes this and other objects by providing a folding seat including a folding frame having two interconnected wire frame members. Torsion springs are provided for biasing the wire frame members apart. The frame members are surrounded by a fabric which provides a back portion, a seat portion, and at least one seat side. Upon collapsing of the folding frame from a seating position to a carrying position, against the biasing force of the torsion springs, the seat side will either fold in or out, providing a convenient carrying member or bag-like device. The folding seat is maintained in the carrying position, in which it serves as a carrying bag or satchel, by securing a pair of straps to a pair of releasable securing retainers.

Handles can be provided at open ends of the back portion and the seat portion.

Further, the securing straps can be hook-and-loop fasteners. The securing straps provide adjustability to the folding seat, allowing the folding seat to function as a carrying bag, in that contents of varied amounts can be secured in the carrying bag by adjusting the securing straps.

A bottom face can include an attachment adapted to secure a seat cushion to the folding seat. A suitable attachment, such as hook-and-loop fasteners, can be provided to secure the seat cushion to the folding seat.

It is also contemplated that pockets can be secured to the triangular seat sides for securing various items, such as keys, cigarettes, chewing gum, or portable radios.

An essential feature of the present invention is that the torsion springs bias the back and seat portions to arcuately spread, thereby forming a seat at approximately right angles, where the seat is constrained by the dimensioning of the triangular seat side. Thus, the seat is held open to a sealing position by the torsion springs, and is held closed in a carrying position by the securing straps. The back and seat portions maintain a relatively constant shape, thus providing flat surfaces.

Advertising, artistic designs, or other indicia may be provided on the flat surface of either the inside or outside of the back portion or the seat portion, if desired. For example, the folding seat of the present invention can provide promotional advertising at concerts or other sponsored events by providing an advertisement or company logo on the outside of the back portion of the folding seat. Such an advertisement or logo would be highly visible to individuals either seated behind or passing by the folding seat. Thus, the folding seat of the present invention can serve as an inexpensive advertising medium.

Other objects and advantages of the present will be apparent upon reference to the accompanying description when taken in conjunction with the following drawings.

BRIEF DESCRIPTION OF THE DRAWINGS

FIG. 1 illustrates a perspective view of an embodiment of the present invention wherein a user is sitting in the folding seat of the present invention.

FIG. 2 illustrates a perspective view of an embodiment of the present invention.

FIG. 3 illustrates a side view of an embodiment of the present invention.

FIG. 4 illustrates a front view of an embodiment of the present invention.

DESCRIPTION OF THE PREFERRED EMBODIMENTS

Figure 5:
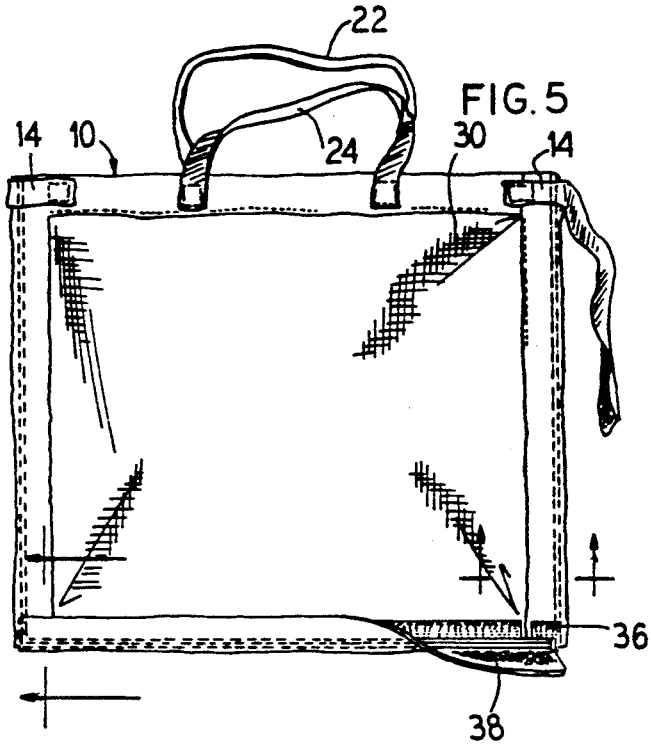
FIG. 5 illustrates a back view of yet another embodiment of the present invention.

A folding seat 10 embodying the principles of the present invention is illustrated in FIG. 1. A user 12 is seated within the folding seat 10. Securing straps 14 are attached to the folding seat 10. A triangular-shaped seat side 16 allows the folding seat 10 to be opened to a seating position, wherein sides 18 and 20 of the folding seat 10 are substantially perpendicular to one another. Optionally, a side storage pocket 26 can be applied to the triangular-shaped seat side 16 of the folding seat 10.

As can be seen in FIG. 2, a handle 22 is attached to a generally rectangular seat portion 28 of the folding seat 10. Another handle 24 is attached to a generally rectangular back portion 30 of the folding seat 10. The handles 22,24 are secured to the folding seat 10 so that when the folding seat 10 is in a carrying position (illustrated in FIG. 3), the handles 22,24 are substantially aligned with each other. The folding seat 10 is secured into the carrying position by securing the straps 14, arranged on the back portion 30, to a pair of releasable securing retainers 32, arranged located on the seat portion 28. The straps 14 and the retainers 32 may be secured together by any suitable securing arrangement, for example by hook-and-loop fasteners.

As illustrated in FIG. 3, the folding seat 10 serves as a satchel when in the carrying position. The triangular-shaped seat side 16 of the folding seat 10 either folds into or out of the folding seat 10 when the folding seating seat 10 is in the carrying position.

As illustrated in FIG. 4, the securing straps 14 are adjustable, so that the space provided within the folding seat 10 for carrying various items is adjustable.

The seat portion 28 and the back portion 30 of the folding seat 10 maintain a relatively constant shape, thus providing flat areas upon which advertisements, artistic designs, or other indicia, such as the design 34, can be provided.

As illustrated in FIG. 5, the folding seat 10 can include an attachment having securing sections 36,38, adapted to secure a seat cushion to the folding seat 10.

Figure 6:
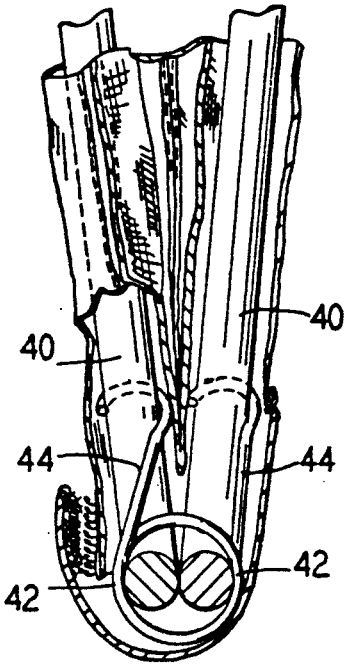
FIG. 6 illustrates a detailed sectional view taken generally along the line VI—VI of FIG. 5 of a folding seat embodying the principles of the present invention.

FIG. 6 illustrates a sectional view of the folding seat 10 taken along the line VI—VI of FIG. 5. A pair of interconnected wire frame members 40 are pivotably attached by torsion springs 42. Each torsion spring 42 includes a pair of hooks 44 for pivotably moving the wire frame members 40.

Figure 7:
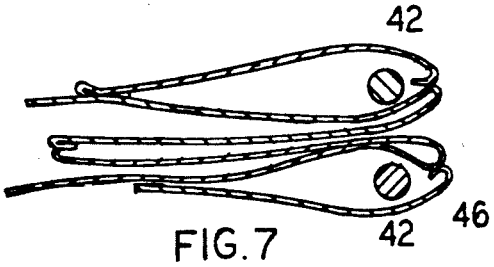
FIG. 7 illustrates a cross-sectional view taken generally along the line VII—VII of FIG. 5 of a folding seat embodying the principles of the present invention.

FIG. 7 illustrates a cross-sectional view taken along the line VII—VII of FIG. 5. FIG. 7 includes a cross-sectional view of the wire frame members 40, and a crosssectional view of the fabric 46 covering the wire frame members 40 of the folding seat 10. The fabric 46 can be any suitable fabric, such as canvas, nylon, cotton, or any other suitable fabric.

Figure 8:
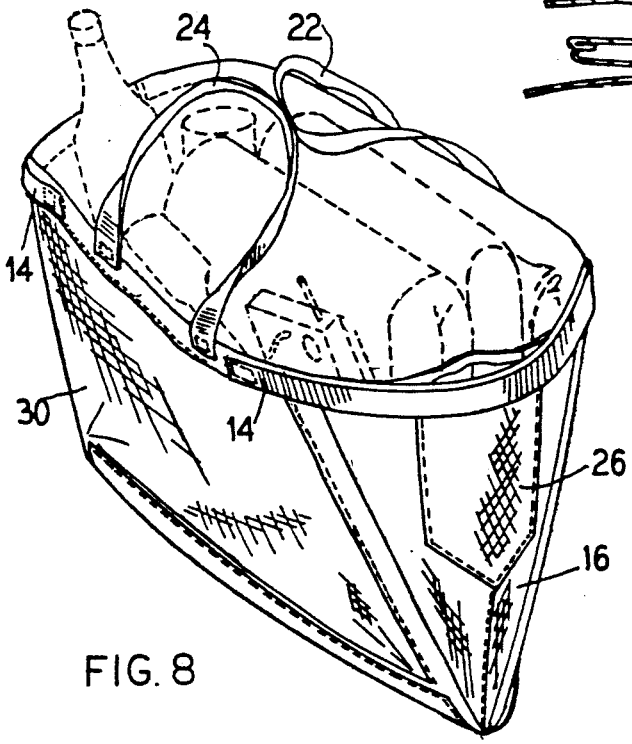
FIG. 8 illustrates a perspective view of yet another embodiment of the present invention.

FIG. 8 illustrates the folding seat 10 of the present invention in a carrying position. In this perspective view, it is shown that the triangular-shaped seat sides 16 may be extended outwardly from the folding seat 10 when the folding seat 10 is in the carrying position. In the carrying position, the folding seat 10 resembles a satchel.

Figure 9:
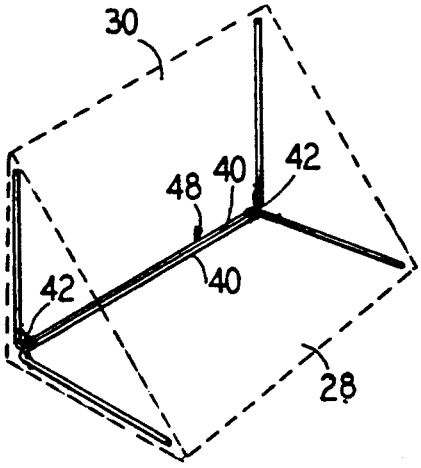
FIG. 9 illustrates a perspective view of the wire frame assembly a folding seat embodying the principles of the present invention, with the seat fabric shown in dotted lines.

FIG. 9 illustrates a folding frame 48 formed by a pair of interconnected wire frame members 40. The wire frame members 40 are biased apart attached by torsion springs 42. The seat portion 28 and back portion 30 are shown in phantom. In the preferred embodiment shown the frame members are U-shaped and connected in a hinge connection at their bights. Other configurations are possible such as square and different hinge connections, separate from the springs may be used.

In a preferred embodiment of the folding seat of the present invention, the fabric 46 surrounds the two interconnected wire frame members 40 to form the seat portion 28, the back portion 30, and the triangular-shaped seat side 16. The two interconnected wire frame members 40 are connected by torsion springs 42 for selectively spreading the wire frame members 40 apart from the carrying position to the seating position.

Further, a pair of adjustable straps 14 are arranged on the back portion 30, and a pair of releasable securing retainers 32 are arranged on the seat portion 28. The folding seat 10 is secured into the carrying position by securing the straps 14 to the releasable securing retainers 32.

In addition, a first handle 22 is attached to the seat portion 28, and a second handle 24 is attached to the back portion 30. When the folding seat 10 is in the carrying position, the handles 22,24 are substantially aligned with each other.

An attachment having securing sections 36,38 is also provided. The attachment is adapted to secure a seat cushion to the folding seat 10.

Although the present invention has been described with reference to specific embodiments, those of skill in the art will recognize that changes may be made thereto without departing from the scope and spirit of the invention as set forth in the appended claims.

I claim:

1. A folding seat comprising:

a first wire frame member having a base, a first side, and a second side;

a second wire frame member having a base, a first side, and a second side, said first wire frame member and said second wire frame member having identical dimensions;

a first torsion spring, mounted on said base of said first wire frame and on said base of said second wire frame, including first and second extensions having hook-shaped end members, said first side of said first wire frame seated in said hook-shaped end member of said first extension, and said first side of said second wire frame seated in said hook-shaped end member of said second extension;

a second torsion spring, mounted on said base of said first wire frame and on said base of said second wire frame, including third and fourth extensions having hook-shaped end members, said second side of said first wire frame seated in said hook-shaped end member of said third extension and said second side of said second wire frame seated in said hook-shaped end member of said fourth extension;

said first and second torsion springs selectively spreading said wire frame members apart from a carrying position to a seating position;

a fabric surrounding said first and second wire frame members to form a back portion, a seat portion, and at least one triangular-shaped seat side;

a pair of straps arranged on said back portion;

a pair of releasable securing retainers arranged on said seat portion;

a first handle attached to said back portion;

a second handle attached to said seat portion; and an attachment connected to a bottom face of said folding seat, said attachment adapted to secure a seat cushion to said folding seat, said triangular-shaped seat side limiting spreading of said wire frame members apart under influence of said first and second torsion springs.

* * * * *